US009945546B2

(12) United States Patent
Hoehler et al.

(10) Patent No.: US 9,945,546 B2
(45) Date of Patent: Apr. 17, 2018

(54) OPTICAL SIGNALING DEVICE

(71) Applicant: WERMA Holding GmbH + Co. KG, Rietheim-Weilheim (DE)

(72) Inventors: Christian Hoehler, Wellendingen (DE); Daniel Kensy, Tuttlingen (DE)

(73) Assignee: WERMA Holding GmbH + Co. KG, Rietheim-Weilheim (DE)

( * ) Notice: Subject to any disclaimer, the term of this patent is extended or adjusted under 35 U.S.C. 154(b) by 49 days.

(21) Appl. No.: 14/856,528

(22) Filed: Sep. 16, 2015

(65) Prior Publication Data

US 2016/0091187 A1 Mar. 31, 2016

(30) Foreign Application Priority Data

Sep. 29, 2014 (DE) ..... 10 2014 114 111

(51) Int. Cl.

| | |
|---|---|
| ***F21V 23/04*** | (2006.01) |
| ***F21V 33/00*** | (2006.01) |
| ***H01H 50/16*** | (2006.01) |
| ***G08B 5/36*** | (2006.01) |
| ***H05B 33/08*** | (2006.01) |
| ***H05B 37/02*** | (2006.01) |
| *F21S 2/00* | (2016.01) |
| *F21W 111/00* | (2006.01) |

(52) U.S. Cl.

CPC ..... *F21V 23/04* (2013.01); *F21V 33/0092* (2013.01); *G08B 5/36* (2013.01);

(Continued)

(58) Field of Classification Search

CPC ..... F21V 23/04; F21V 33/0092; F21S 2/00; F21S 2/005; G08B 5/36; H01H 50/16;

(Continued)

(56) References Cited

U.S. PATENT DOCUMENTS 4,399,434 A * 8/1983 Bielat ..... G01R 13/404 340/691.4
5,103,215 A * 4/1992 Taylor ..... F21V 3/00 340/525

(Continued)

FOREIGN PATENT DOCUMENTS

DE 2 211 801 9/1972
DE 195 13 983 B4 10/1995

(Continued)

*Primary Examiner* — Alan Cariaso
(74) *Attorney, Agent, or Firm* — Breneman & Georges

(57) ABSTRACT

The invention proposes an optical signaling device, in particular a signaling lamp or a modular signaling column (1) or the like, having at least one luminous unit (2) comprising at least one luminous element (20) for optically indicating one or more different operating states of a technical device such as a machine, an installation or the like, at least one electrical and/or electronic connection unit (27) being provided for the purpose of connecting or making contact with at least the technical device, at least one electrical and/or electronic linking unit (12) being provided between the connection unit (27) and the luminous unit (2) for the purpose of electrically and/or electronically linking the connection unit (27) to the luminous unit (2), thus implementing additional technical possibilities or functionalities. This is achieved according to the invention by virtue of the fact that the linking unit (12) has at least one electrical and/or electronic switching element (21, 22) for establishing and/or disconnecting the electrical and/or electronic link between the luminous unit (2) and the connection unit (27), the electrical and/or electronic switching element (21, 22) also being in the form of an actuator switch (21, 22) for switching at least one actuating element (28) of a first actuator (8) of the technical device and/or a second actuator (8) which is separate from the technical device.

10 Claims, 2 Drawing Sheets

Figure 1:
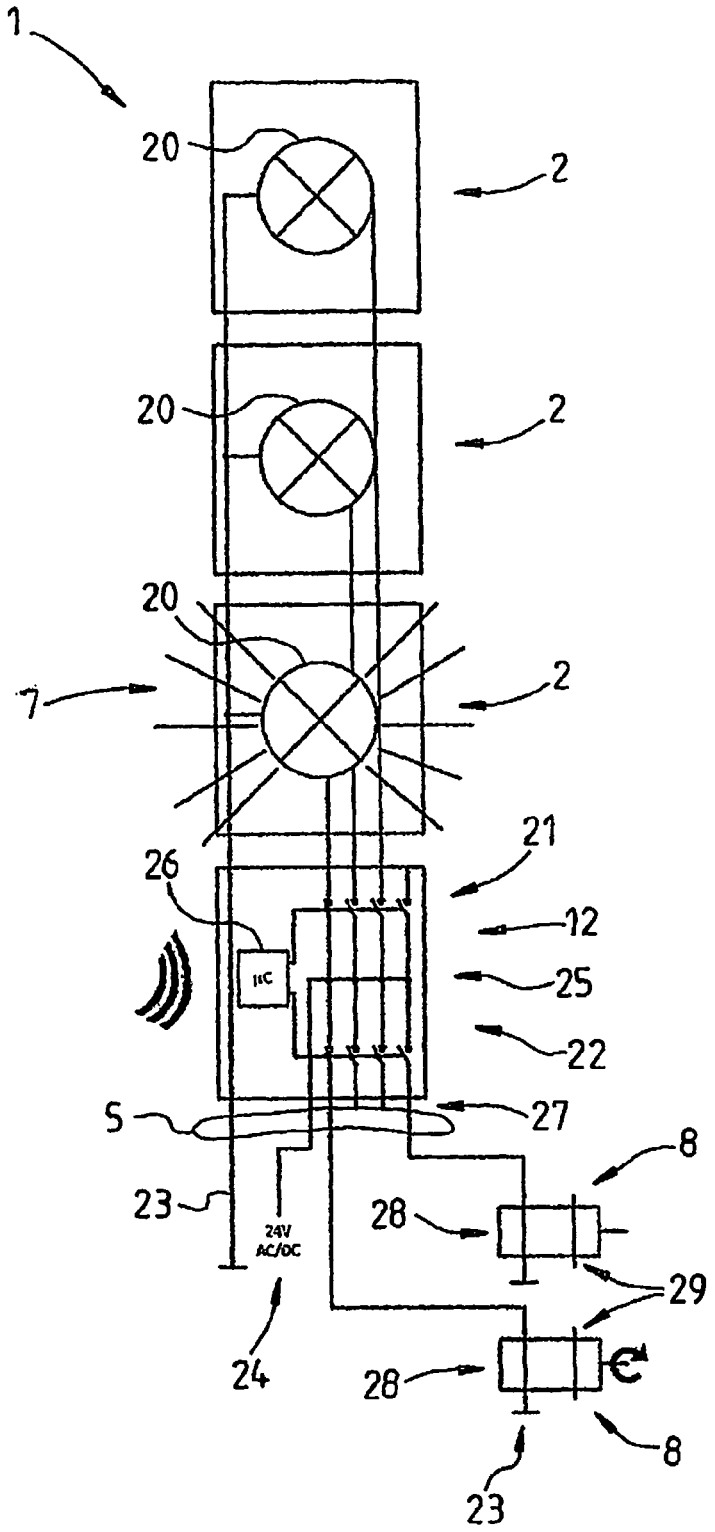

(52) U.S. Cl.
CPC ..... *H01H 50/16* (2013.01); *H05B 33/0857* (2013.01); *H05B 37/0272* (2013.01); *F21S 2/00* (2013.01); *F21W 2111/00* (2013.01)

(58) Field of Classification Search
CPC ..... H05B 33/0857; H05B 37/0272; F21W 2111/00
USPC ..... 340/679, 815.45; 315/320, 321, 322; 116/202
See application file for complete search history.

(56) References Cited

U.S. PATENT DOCUMENTS 5,774,528 A * 6/1998 Bogner ..... H04L 12/2825 340/533
5,963,126 A * 10/1999 Karlin ..... B60Q 7/00 340/321
7,587,178 B2 * 9/2009 Marquardt ..... G08B 7/06 340/5.3
8,395,526 B2 * 3/2013 Kensy ..... G08B 5/36 340/332
8,456,322 B2 * 6/2013 Marquardt ..... G08B 5/36 340/332
2004/0203701 A1 * 10/2004 Wilson ..... G08B 5/36 455/422.1
2006/0097861 A1 * 5/2006 Marquardt ..... G08B 5/36 340/507
2006/0164255 A1 * 7/2006 Humbert ..... G05B 19/048 340/679
2007/0239400 A1 * 10/2007 Skorpik ..... F16K 37/00 702/188

FOREIGN PATENT DOCUMENTS

EP 1 650 489 B1 8/2007
EP 2 182 494 B1 10/2011
FR 81 21903 5/1983

* cited by examiner

OPTICAL SIGNALING DEVICE

The invention relates to an optical signaling device, in particular a signaling lamp or a modular signaling column or the like, having at least one luminous unit comprising at least one luminous element for optically indicating one or more different operating states of a technical device such as a machine, an installation or the like according to the precharacterizing clause of Claim 1.

PRIOR ART

DE 19 513 983 A1 by the applicant has already disclosed, for example, a signaling column having a plurality of replaceable modules, a bayonet fitting arrangement being provided for the purpose of mechanically and electrically linking the individual luminous/replaceable modules to one another. In this case, the electrical contact-making is already achieved with the mounting of the replaceable modules.

Generally, such replaceable modules inside a signaling column have different colors. The color combination of traffic lights is often selected, with the color green representing fault-free operation and the color red representing a hazard or a standstill of the machine etc., for example.

In the case of these signaling columns, the energy supply and the corresponding signaling have already been achieved for decades by applying voltage to the power lines/circuits of the respective luminous modules. For this purpose, the signaling columns have different electrical connections which are linked to the technical device to be monitored using electrical lines and then have electrical voltage applied to them by this device as soon as a process to be indicated, for example an error or a fault, occurs in/from the technical device (cf. DE 22 11 801, FR 2 517 021). In this case, in addition to the common so-called "ground" or the common reference potential, a luminous element or luminous module is respectively specifically assigned to each further connection line of the signaling device. An electrical line which electrically links the technical device to the signaling column is respectively directly assigned to a luminous or replaceable module. For example, "line no. 3" is continuously (exclusively) linked to the red "third" luminous module or its luminous element/LED in an electrically conductive manner, with the result that this module lights up red when the device applies electrical voltage to this "line no. 3" because, for example, a standstill of the device or a tool breakage occurs in the technical device to be monitored or the machine tool.

In practice, it has been shown that the operating state of the technical device to be monitored may be of interest not only to the operator in situ but possibly also to the foreman or a manager or to an operator who is not always in situ at the technical device. Accordingly, the documents DE 10 2004 0123 09 A1 and EP 1 650 489 B1, for example, have already disclosed corresponding replaceable modules or signaling columns which transmit the operating states of the technical device or the operating state of the warning lamp to a cell phone belonging to the operator, for example, via wireless communication, for example by means of a corresponding SMS or the like.

EP 2 182 494 B1 has already disclosed a network having a plurality of signaling devices or signaling columns, the signaling columns being networked, separately from the possibly networked machines, via a common transmission path and therefore forming a separate network. The operating states of the signaling columns and therefore of the devices to be monitored can thereby be centrally indicated and (statistically) evaluated using a computer or a screen or mobile cell phone, PDA etc.

OBJECTS AND ADVANTAGES OF THE INVENTION

In contrast, the object of the invention is to propose a signaling device which is used to implement additional technical possibilities or functionalities.

Starting from a signaling device of the type mentioned in the introduction, this object is achieved by the characterizing features of Claim 1. Advantageous embodiments and developments of the invention are possible as a result of the measures mentioned in the subclaims.

Accordingly, a signaling device according to the invention is distinguished by the fact that the linking unit has at least one electrical and/or electronic switching element for establishing and/or disconnecting the electrical link between the luminous unit and the connection unit, the electrical and/or electronic switching element also being in the form of an actuator switch for switching at least one actuating element of a first actuator of the technical device and/or a second actuator which is separate from the technical device.

With the aid of this measure, the signaling devices or warning lamps according to the invention can also advantageously be in the form of "active control components" in a system or machine complex. This means that the signaling device(s) according to the invention may advantageously generate/emit their own variable control commands "to the outside" and are therefore "themselves actively operative" or may "activate" the actuating element and therefore the separate or external actuator. The switching element according to the invention may optionally generate the information "zero" or "one" and may advantageously forward this information "to the outside", that is to say outside the signaling device, to the actuating element and may hereby influence/change the actuating element or its state. In this case, the system or the machine complex comprises at least the signaling device and the technical device to be monitored and/or separate external machines, units or other actuators.

In contrast, previous signaling devices according to the prior art are only in the form of "passive components", that is to say they receive electrical energy/information "from the outside" or are supplied with electrical voltage/current and therefore with control commands/information "from the outside" at the respective connection of the signaling device in a defined manner by the technical device to be monitored and "react passively" (without their own possible way of changing the information or control commands) with their signaling or the glowing/indication and are therefore "inactive per se".

In the sense of the invention, an actuator should be understood as meaning a converter or a drive element which can be controlled by the signaling device and preferably converts electrical signals or energy into mechanical movement, in particular into rotational movement as an electric motor, or into other physical variables, for example pressure or temperature. Electrical, pneumatic and/or hydraulic actuators may preferably be provided.

The external actuating element may be advantageously controlled using the electrical and/or electronic switching element in the form of an actuator switch. According to the invention, external/separate components or actuators can now be advantageously controlled, which was hitherto not possible using the previous "passive" signaling devices. This means that the actuating element(s) and therefore at least the external/separate actuator can be switched on, that is to say activated, and also switched off, that is to say deactivated, using the electrical and/or electronic switching element in the form of an actuator switch.

The actuating element(s), for example in the form of an electromechanical/electromagnetic control relay, electronic transistor or the like, advantageously make(s) it possible for it/them to be controlled using a low voltage, for example, and for the actuator(s) to be advantageously operated/supplied using another or "external" energy source, for example three-phase current, 230 V mains voltage, hydraulic oil pressure, compressed air or the like. That is to say, according to the invention, the actuating element and therefore the actuator can be switched or controlled by the switching element or the actuator switch of the optical signaling device using a (small) control voltage, for example 12 V or 24 V.

In the sense of the invention, an "external actuator" or a "separate actuator" should be understood as meaning an actuator which is not (simultaneously) the signaling device or is not a (different/second) signaling device or a signaling column or an indicating unit for signaling/indicating the operating state(s) of a/the technical device to be monitored. That is to say, this actuator according to the invention does not have the functionality of signaling a/the operating state but rather has a different or separate technical functionality. For example, this actuator according to the invention may be in the form of an electric motor which generates a mechanical rotational movement and in this case sets a conveyor belt, a milling spindle head or a robot arm etc., for example, in motion.

For example, the signaling device according to the invention can activate or switch/actuate an actuating element or a corresponding actuator for closing a fire door or for opening an escape door on the basis of a sensor/sensor information or a fault in the technical device to be monitored which is particularly dangerous to humans.

This is a complete departure from the previous signaling devices which are only/exclusively "passive", that is to say have voltage applied to them from the outside/externally if required in order to indicate or signal the respective operating state (without their own control) using the luminous element. The technical device to be monitored or other actuators have previously only ever been controlled by themselves or by their own controllers.

In contrast, the invention is used to actively control/influence separate/external actuators of the technical device to be monitored or other external actuators/components using the optical signaling device according to the invention or its advantageous switching element.

One particular advantage of the invention is that, for example, a wide variety of devices such as machine tools or the like each having a wide variety of electronics or controllers or operating systems cannot only be monitored, but also a wide variety of actuators can now be additionally controlled, together or in a centralized manner using the signaling device according to the invention. In this case, a common network or electrical and electronic communication system is advantageously formed.

In the case of large production plants or industrial warehouses or the like, it is conventional for example that machines, for example from the middle of the last century, having a retrofitted or subsequently installed electronic controller can be found, just as machines from the end of the last century having a special electronic control bus as well as the very latest, highly complex machines which can be operated in an automated manner and have novel bus systems are present. The invention advantageously does not access the wide variety of controllers or bus systems etc. of this wide variety of devices/machines to be monitored, but rather implements a common interlinked network with the signaling device or preferably a plurality of signaling devices. Accordingly, with the aid of the invention, there is no need for a complicated link or a link which is sometimes virtually impossible to implement between the wide variety of machines or machine controllers using complex interfaces or the like.

According to the invention, further or any desired actuators can be advantageously controlled, for example building technology actuators etc., that is to say actuators which are not part of the devices being monitored or to be monitored. If necessary, all existing or controllable components of a production plant can therefore be fully advantageously networked according to the invention. This means that the device(s)/machine(s) to be monitored and/or the optical signaling device(s)/signaling column(s) and/or the building technology, for example the air-conditioning system or building heating/ventilation system, and/or doors/gates and windows, and/or mobile devices belonging to the operators such as smartphones, pagers, PDAs, notebooks etc. and/or (autonomous) transport vehicles and/or automated goods/parts warehouses or high-bay warehouses etc. are comprehensively monitored and can now also be additionally controlled using the signaling device according to the invention.

According to the invention the signaling device(s) according to the invention advantageously implement(s) a separate or parallel network to the technical devices to be monitored or further actuators/components of the production plant or even of the entire company. That is to say, the invention preferably implements a signaling device transmission path which is advantageously separate from or parallel to the transmission path of the electronic monitoring apparatuses of the technical devices or the electronic device links and/or is at least partially wireless or uses radio transmission.

A plurality of signaling devices according to the invention which are networked to one another preferably have a common way of communicating or a standard bus system. Accordingly, the development, production and implementation or start-up etc. can be carried out in a standardized manner and can be carried out independently with respect to the devices to be monitored or other components/actuators. This results, inter alia, in large quantities or in standardized or universal signaling devices or hardware components and/or software/programming etc., which is economically a decisive advantage.

In addition, the invention can be universally used in a previously unparalleled manner. In principle, the electronic signaling device link/networking could also be implemented in a completely cable-based manner, but this does not appear to be very practicable. For example, long transmission paths, for example in industrial warehouses etc., can also be bridged, on the one hand, and retrofitting operations in existing industrial premises can be achieved, on the other hand, in particular by using the at least partially wireless control signal and/or data transmission, without a large amount of effort.

In existing industrial premises in particular, it is often virtually impossible to install separate, relatively long cables for data transmission, for example to the office belonging to the production manager or to the building heating center etc., for example in the case of a machine arranged in the central region of a large production hall.

In addition, mobile devices or vehicles can also be monitored and controlled/operated or switched on/off, that is to say can be universally and completely incorporated in the network according to the invention, as a result of the wireless control signal and/or data transmission. For example, vehicles such as forklift trucks, tractors etc. can be incorporated in the network according to the invention. Accordingly, if necessary, virtually all relevant devices whose operating states are intended to be monitored or other actuators/components of the production plant can be networked and preferably centrally detected or monitored/controlled according to the invention.

Consequently, according to the invention, a wide variety of technical devices or components can be comprehensively networked and controlled/regulated with the aid of the invention without a large amount of effort. This is a considerable improvement when monitoring or operating a plurality of technical devices.

In one preferred variant of the invention, at least one central detection unit is provided for the purpose of detecting operating states of at least two different signaling devices/warning lamps and the actuating element(s) and/or actuators. This makes it possible to advantageously centrally detect and/or monitor and/or check or control and/or evaluate and/or indicate the operating states of the luminous units and/or the signaling devices and the actuating elements/actuators. This may be carried out both in real time or in a timely manner and remotely in terms of time or some time later. Accordingly, this measure signifies a decisive improvement in the operational reliability when monitoring the components in a production plant or in a building. For example, the central detection unit can be positioned far away from and/or in a different building from the devices or warning lamps to be monitored.

For example, it is possible for a single operator at a particular location or in the region of a single signaling device/warning lamp and/or a central indicating component of the network to also monitor the or all other signaling devices/warning lamps and therefore to indirectly monitor the operating states of all or the other technical devices to be monitored, for example CNC machine tools, printing machines, conveyor belts etc., without a large amount of effort and also to control and/or receive an indication of the operating states of the actuators/actuating elements.

The central detection unit is advantageously in the form of a computer, in particular a portable computer. As a result, it is possible to resort to commercially available components which are preferably advantageously designed using advantageous software and possibly special hardware components. This achieves an economically favorable implementation of the invention.

The link or networking of corresponding components advantageously comprises a plurality of transmitters and/or receivers for wirelessly transmitting data between at least two signaling devices/signaling columns and/or the actuating elements/actuators and/or further components and/or the central detection unit. A particularly flexible link/networking is possible with the aid of such a radio link between two signaling devices and/or further components or between virtually all users/components of the signaling device network.

A holding element and/or a base for holding the signaling device at an operating position and/or a module which can be replaced without tools preferably comprise(s) at least the switching element. This makes it possible to retrofit an already existing signaling device according to the invention without a large amount of structural and financial outlay.

The subsequent installation of the invention in particular, for example in a factory hall or in a building having a plurality of technical devices or machines which are intended to be controlled with monitoring using signaling devices according to the invention and having a wide variety of actuating elements/actuators, can be advantageously achieved with the aid of a wireless link.

In one advantageous variant of the invention, the linking unit has at least two electrical and/or electronic switching elements which are arranged, in particular, in succession or along the electrical and/or electronic link and are intended to establish and/or disconnect the link between the luminous unit and the connection unit. The two switching elements can preferably be assigned or are assigned in a unique or defined manner to a luminous unit. This advantageously makes it possible to decouple the operation or indication/glowing of the luminous unit from other functionalities and/or other control or actuation processes.

At least one branch-off point having an electrical supply line for supplying electrical energy is preferably arranged between the two electrical and/or electronic switching elements, with the result that two electrical circuits or supply circuits which can be switched separately can be formed. The electrical supply line may have the reference potential or an electrical pole/connection point of the supply voltage, and the luminous unit can be supplied with electrical energy/voltage or switched on using one switching element, that is to say a signaling circuit comprising at least the luminous element can be closed and/or opened or switched (inside the signaling device).

The external actuating element of the actuator to be controlled can be supplied with electrical energy/voltage or switched on using the other or second switching element which is advantageously in the form of the actuator switch. That is to say, a control circuit which is substantially formed outside the signaling device and preferably does not comprise the luminous unit can likewise be advantageously closed and/or opened or switched inside the signaling device. This generates two circuits which can be separately controlled or switched and advantageously partially "overlap", that is to say have the common branch-off point and the common supply line. These circuits are therefore arranged or connected substantially electrically in parallel with one another.

In contrast to the design according to the invention, this "second switching element" is arranged in a manner completely separate from/independent of or outside the signaling device in the prior art, for example in the form of a switch in the technical device to be monitored. The control of the external actuating element or actuator according to the invention is therefore a complete departure from the prior art in which such control of an external actuator could not be carried out by the signaling device but rather has hitherto been carried out manually and/or by means of a device controller such as a PLC etc.

The two electrical and/or electronic switching elements are advantageously in a closed switching position at least in a switching phase, with the result that the electrical link between the luminous unit and the connection unit is electrically conductive. This couples the signaling by means of the luminous unit and the switching of the actuating element or actuator using control technology. In the case of the "hopper almost empty" state for example, the "yellow luminous unit" is switched on and the actuating element or external actuator is simultaneously used to activate or switch on a transport unit/belt or the like in order to refill the hopper.

If appropriate, (the respective) two switching elements and the luminous element of a luminous unit are part of a common circuit to which voltage can be applied.

At least one monitoring unit is preferably provided for the purpose of monitoring/controlling and/or actuating the electrical and/or electronic switching element(s). This measure enables advantageous monitoring/control inside the signaling element. For example, the monitoring unit may comprise a transmitter and/or receiver for wireless control data or information, with the result that the electrical and/or electronic switching element(s) can be actuated or switched on the basis of corresponding data or information.

An item of information or control data can generally be transmitted, for example, from a sensor or a computer/processor etc. to the monitoring unit (wirelessly and/or via an electrical line) and the electrical and/or electronic switching element(s) can then be actuated or not actuated on the basis of this information/data in order to switch a luminous element on or off and/or to switch an actuating element or an external actuator on or off according to the invention.

In the case of a plastic injection molding machine to be monitored by the signaling device for example, the number of parts produced can be advantageously detected using a sensor or a light barrier or the like and a desired/actual comparison advantageously determines that only relatively few parts need to be produced, as a result of which an item of electrical information is transmitted to the monitoring unit of the signaling device and this unit actuates/switches an actuating element of the plastic heating system of the plastic injection molding machine according to the invention using the actuator switch, with the result that said heating system is deactivated or switched off. Alternatively, time-dependent control of the heating system could also be implemented, for example approximately one hour before the (likely) end of production, that is to say when all parts have been produced, the plastic heating system is switched off with the aid of the signaling device or the actuator switch according to the invention. The (few) parts which have not yet been produced can therefore be produced using the "residual heat" or the remaining liquid plastic from a heatable supply unit in order to save energy. The signaling device according to the invention hereby controls the production of injection-molded parts or the like in a novel manner.

The holding element and/or the base and/or the module which can be replaced without tools advantageously comprise(s) at least the monitoring unit. This makes it possible to retrofit an already existing signaling device according to the invention without a large amount of structural and financial outlay.

The signaling device is preferably in the form of a signaling column, at least one replaceable module or a plurality of almost structurally identical replaceable modules being provided. Modules are preferably provided, a base or a holding element for holding the signaling device at an operating position or a further module for a signaling device being able to be released and fixed without tools at a first end of the module, and a further module for a signaling device or a covering element being able to be released and fixed without tools at a second end of the module.

In one particular development of the invention, the actuator switch of the signaling device controls or actuates/switches an actuating element or an actuator of the device to be monitored and/or a component of the building in which the signaling device and/or the device to be monitored is/are preferably arranged, at least one component of a heating system and/or a ventilation system and/or an air-conditioning system and/or a production machine being in the form of the actuator. One or more signaling devices or signaling columns according to the invention open up completely novel technical possibilities, inter alia, for advantageous production control, in particular the implementation of the so-called "industry 4.0" or networked and/or retrofittable and/or self-organized and/or flexible production/manufacturing, so-called "cloud-based systems" and/or so-called "lean production"

control of the building technology, so-called "smart building"

cost-saving energy consumption/supply, efficient use of energy, in particular fluctuating amounts of energy offered by regenerative energy sources, for example a PV installation on the roof of the building, so-called "smart grid", temporal adaptation to the energy offered or the energy prices/tariffs, etc.

EXEMPLARY EMBODIMENT

Figure 2:
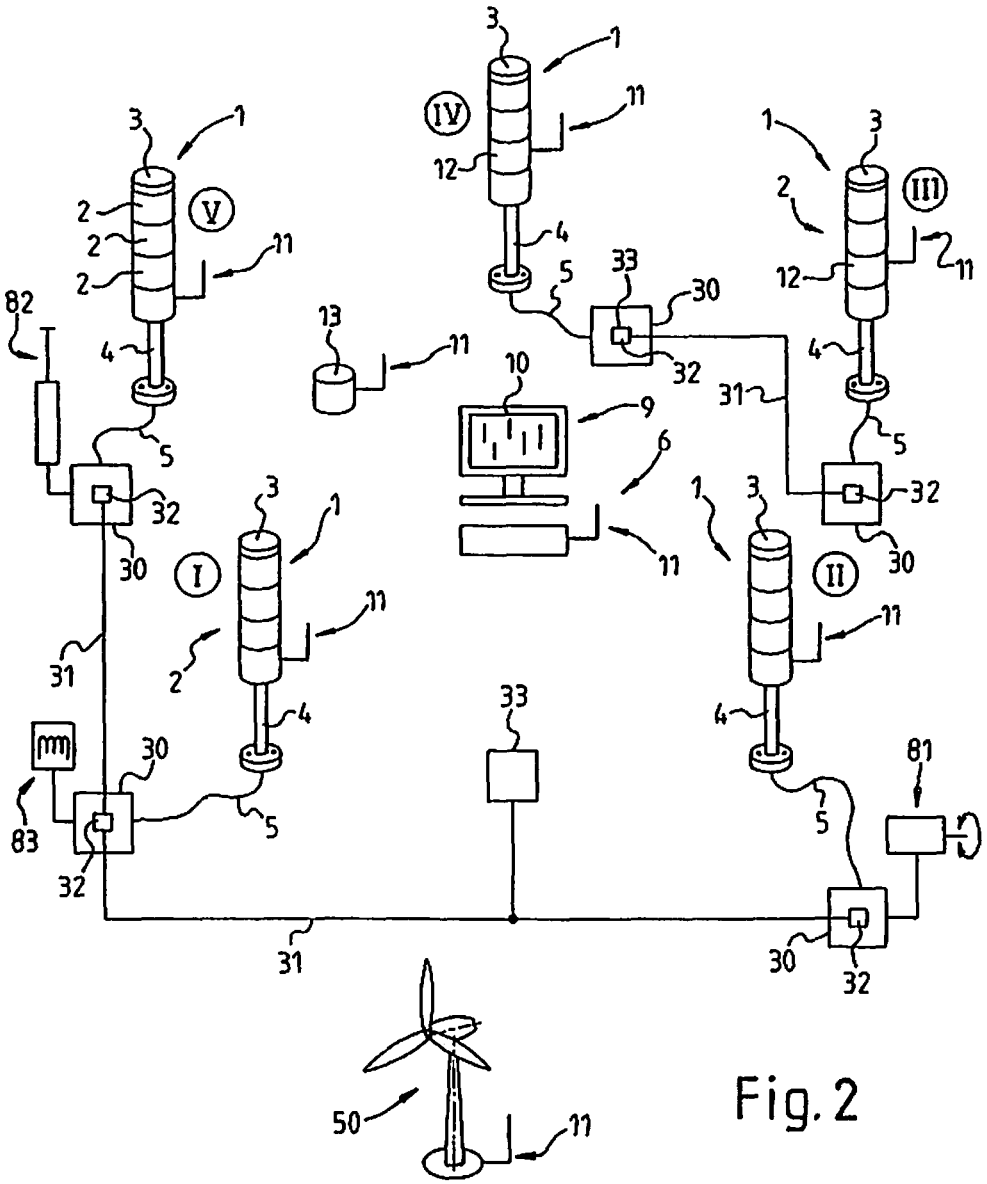

One exemplary embodiment of the invention is illustrated in the drawing and is explained in more detail below using the figures, in which in detail:

FIG. 1 shows a schematically illustrated signaling device according to the invention having three replaceable modules, and FIG. 2 shows a schematic illustration of a signaling device network having five signaling devices according to the invention and a central computer monitoring system as well as a plurality of actuators.

FIG. 1 depicts a signaling device 1 in the form of a signaling column 1 having three schematically illustrated replaceable modules 2 and a radio module 12 comprising a transmitter and/or a receiver, the schematically depicted arcs being intended to symbolize the "radio waves" or the wireless transmission of information.

The signaling column 1 is conventionally linked to a technical device (not illustrated in any more detail) by means of a (multi-core) cable 5 in order to indicate or be able to signal the operating states of said device. For this purpose, the signaling column 1 has a plurality of electrical connections 27 to which the cable 5 and the cores are connected.

In the illustrated embodiment variant of a signaling column 1 with a radio module 12, it is also possible to implement an alternative or second link to the device to be monitored. The operating states of the device can also be transmitted by radio from a transmitter and can be received using the radio module 12 or its receiver. In this case, the receiver of the radio module 12 is (also) the corresponding "connection" or the "connection unit" of the signaling column 1 in the sense of the invention.

This "connection" or these two "connections" (connection 27 and/or receiver of the radio module 12) is/are electrically or electronically linked to the replaceable modules 2 and the luminous elements 20 in the sense of the invention. In the exemplary embodiment depicted, an electrical and/or electronic switching element 21, 22 in the sense of the invention is the switches 21 and the switches 22. In the present case, the switches 21, 22 are electrically linked, inter alia, to the cable 5 and its cores. The switches 21, 22 each form a circuit or a section of a circuit provided inside the signaling device 1 each comprising one of the luminous elements 20 or LEDs or the like. In this case, a reference potential 24 or a supply voltage 24 (24 V AC/DC) is provided. The connection of the signaling column also comprises grounding 23 or so-called ground in the form of a so-called "opposite pole" to the reference potential 24 or for closing the respective circuits.

In the illustrated example, said switches are controllable switches 21, 22 which are in the form of semiconductor transistors, for example, and can be controlled or switched by a monitoring unit 26 or a microprocessor 26. The monitoring unit 26 is also advantageously linked to the radio receiver (not depicted), with the result that the monitoring unit can also use radio information for switching/controlling the switches 21, 22. In addition, a "logic unit" or software and/or a data memory may be provided in the radio module 12, with the result that the switches 21, 22 can also be controlled using further commands or information/instructions.

In principle, additional or a wide variety of instructions or instructions which change on account of software changes, special framework conditions or the like can also be transmitted from an external processor or computer/server or the like to the monitoring unit 26, in particular by means of radio transmission. For example, a sensor (not illustrated in any more detail) or a smoke detector can report to the signaling column 1 that there is a fire in the building, preferably by means of radio transmission. For example, the monitoring unit 26 can close the switch 21 for the "red" replaceable module 2 and can additionally possibly trigger a pager or siren (not illustrated in any more detail), with the result that persons present (inter alia on account of the special fire tune of the siren and the fact that all signaling columns 1 possibly light up "red" at the same time) are alerted.

According to the invention, the signaling column 1 in the example schematically illustrated in FIG. 1 controls two actuating elements 28 of two actuators 8 which are sketched here as electric motors 8. In this case, the switches 22 are in the form of actuator switches 22. In the sense of the invention, the switches 22 (and also the switches 21 in the present case), in particular, are incorporated/arranged in the respective circuit(s) or electrical and/or electronic links between the connections 27 or the radio receiver of the radio module 12 (via the microcontroller 26) and the replaceable modules 2 or luminous elements 20.

A branch-off point 25 or a line to the reference potential 24 is respectively provided between the switches 21 and switches 22 of the respective circuits, with the result that an "internal circuit" is formed, on the one hand, from the reference potential 24, via the branch-off point 25 and the switch 21, to the luminous element 20 and back to the grounding 23. On the other hand, an "external circuit" is respectively formed in a parallel manner from the reference potential 24, via the branch-off point 25 and now via the switch 22, to the cable 5 and therefore to the "external" actuating element 28 for actuator 8 and finally to the grounding 23 of the actuator 8. The actuator 8 may be part or a component of the device to be monitored or may be an actuator 8 separate therefrom, for example the ventilation system of the factory building etc.

According to FIG. 1, the two switches 21 and 22 depicted "on the left-hand side" are closed, with the result that the lower or "green" replaceable module 2 or its luminous element 20 is on and the "lower" actuator 8 or electric motor 8 illustrated in the image rotates at the same time (cf. spin arrow) or is controlled. In contrast, the other switches 21, 22 are in an opened position, with the result that the other replaceable modules 2 or the other actuator 8 is/are not in operation or "controlled".

For example, a relatively small control voltage (24 V AC/DC) is applied to/is used to control the actuators 8 according to FIG. 1 and voltage is applied to/is used to control its actuating element 28, for example a relay, by means of the signaling column 1, by an energy supply 29, for any desired voltage for example a three-phase current/heavy current, of approximately 380 V is hereby switched for the purpose of driving the electric motor 8 or the actuator 8.

FIG. 2 only schematically illustrates a networked system, the radio module 12 of the signaling column 1 being wirelessly linked to and being able to interchange data/information with other signaling columns 1 or a computer 9 etc. by means of an (externally fitted) antenna 11. The signaling columns 1 are closed at the top using a cover 3, for example. The signaling columns 1 are advantageously fastened to the technical device 30 (only very schematically illustrated) or to the technical device to be monitored such as a machine tool 30 or the like preferably using a base 4.

The operating states of the technical device 30 (not illustrated in any more detail) are preferably supplied to the signaling column 1 via a cable 5. In this case, communication between the technical device 30 to be monitored and the signaling column 1 (not illustrated in any more detail) is effected in a previously conventional manner using a controller 32 of the machine 30, for example. However, it is also possible to implement addressed transmission of the respective operating states for advantageously addressed replaceable modules 2. This variant is particularly advantageous, in particular, when using an internal bus system inside the signaling column 1.

The devices or machines 30 which are arranged at the front in FIG. 2 and are to be monitored in the front signaling columns 1 are electrically linked or networked to one another by means of a machine link 31, by way of example. In the case example according to FIG. 2, although the signaling columns 1 and machines 30 arranged at the rear are networked to one another, they are not networked to the front machines 30.

In this case, all signaling columns 1 are therefore networked or linked to one another separately or parallel to the machines 30 in order to be able to interchange data or control signals.

FIG. 2 schematically illustrates a signaling device network, in which case the total of five signaling columns 1 are advantageously linked to the corresponding technical device 30 to be monitored, such as a machine tool 30 or the like, or to its own respective machine controller 32 via cables 5.

In addition to the five signaling columns 1 each labeled using Roman numerals, a central detection and evaluation unit 9 is provided, that is to say a computer 9 or processor or the like. The central computer 9 also has a screen 10 for indicating the operating states of the signaling columns 1.

In the illustrated exemplary embodiment, bidirectional communication between the signaling devices 1 is advantageous, which communication is carried out in a completely wireless manner or via radio by means of antennas 11. For example, the bases 4 of the signaling columns 1 having the Roman numerals I, II and V each comprise the antenna 11. In contrast, the signaling columns 1 having the Roman numerals III and IV each have a radio module 12 which is in the form of a replaceable module and has the antenna 11.

In contrast, the machines 30 to be monitored form two machine networks which are formed separately to the signaling device network and accordingly communicate via cable links 31. In this case, one of the two machine networks comprises a machine center 33 which centrally controls three of the machines 30 with the inclusion of the internal machine controllers 32.

The signaling columns 1 according to FIG. 2 have the feature in common that three luminous units or replaceable modules 2 are respectively provided for the purpose of indicating accordingly different operating states of technical devices (not illustrated in any more detail) such as machine tools or the like.

In addition, it is also possible to provide a so-called router 13 having an antenna 11, which router can be arranged, for example, between the computer 9 and particularly remote signaling columns 1 in order to advantageously bridge relatively long radio paths. If appropriate, a plurality of signaling columns 1 can be assigned to a router 13, for which the router 13 transmits corresponding radio signals to the computer 9.

For example, the antenna 11 of the computer 9 may be in the form of a separate component which can be linked to the computer 9, in particular, by means of a plug-in connection such as a USB connector or the like. The signaling columns 1 or the existing components, that is to say the network topology, and current or past operating states can be advantageously centrally detected, monitored and represented with the aid of advantageous software on the computer 9. This also makes it possible to statistically evaluate and visualize chronologically stored operating states, in particular, over a desired period such as a month, a year etc., for example using a data memory of the computer 9. In principle, advantageous bidirectional communication may be provided in all illustrated and described components.

When using radio modules 12 and radio antennas 11 to wirelessly link 6 the signaling columns 1 to the computer 9 and to one another between the warning lamps 1 in particular, it is particularly advantageous to codify or address the signaling columns 1 or luminous units or replaceable modules 2.

In the exemplary embodiment according to FIG. 2, the central computer 9, for example, can both receive data or operating states of a signaling column 1, for example having the Roman numeral I, and can possibly forward said data or operating states to another signaling column 1, for example Roman numeral II, with the result that the signaling column 1 having the Roman numeral II now indicates or represents the operating state of the signaling column 1 having the Roman numeral I for a special application. According to the invention, there is accordingly a link between the signaling columns 1 of the illustrated warning lamp system, in which the computer is integrated. The router 13 can also accordingly be used without the central computer 9, for example, being involved in this communication in a special way.

In addition to the components illustrated, the signaling device network can generally transmit an operating state or the operating states of the signaling columns 1 to a separate additional device, for example a cell phone, a mobile PDA, a portable computer or notebook or the like, in particular using wireless links or antennas 11. When advantageous wireless communication is used, it is possible to resort, for example, to already known wireless transmission systems such as GSM, UMTS, WLAN, Bluetooth, ZigBee or others.

In principle, it is advantageous that, when a replaceable module 12 in the form of a radio module 12 is used in particular, conventional signaling columns 1 which are/have been constructed substantially from replaceable modules 2 can be retrofitted or upgraded without a large amount of effort, with the result that a plurality of signaling columns 1 form an advantageous network and can combine a wide variety of devices or machines. In this case, the network does not need to be matched to the internal communication of the device 30 to be monitored. In practice, a plurality of different internal machine communication systems which are networked or not networked or only partially networked can often be found inside a production plant or machine hall etc. It is now possible to set up separate or parallel communication or networking of the signaling columns 1 without a large amount of effort (without special software and hardware). This network can be implemented in a few minutes, for example by installing the radio module 12 and installing software onto a computer 9.

In addition, further very different components can be incorporated in the network of the signaling columns 1. For example, an "external" actuating element 28 or actuator 8 can be advantageously controlled using a signaling column 1 according to the invention, as already explained in more detail above with respect to FIG. 1. This is schematically indicated in FIG. 2 using the different actuators, for example the electric motor 81, the hydraulic cylinder 82 and an electrical heating coil or heating system 83, which are each in the form of a part or component of the machines 30 to be monitored in the present example.

In addition, FIG. 2 illustrates a wind power plant 50 having an antenna 11 in order to outline the fact that any other components can also be incorporated in the signaling device network. An item of information relating to the energy production of the wind power plant 50 or of a PV installation on the roof of the factory building can be transmitted to the network by radio. This information can then be used to optimize the power consumption on the basis of the inherent power production, for example, by virtue of the central computer 9 possibly transmitting an instruction/information item to one of the signaling devices 1, with the result that it switches the heating system 83 on or off, for example. In this case, further production parameters can be advantageously taken into account, for example the number of items yet to be produced such as injection-molded parts or the likely end/reaching of the desired quantity of the machine 30 etc. Alternatively or in combination with this, the heating system 83 could also be a service water heating system 83 of the heating installation of the factory building, which can therefore be used as an advantageous "wind energy store".

The individual exemplary uses outlined briefly above can only be used to indicate a first presentation of the virtually unlimited possible ways of controlling "external" actuating elements 28 or actuators 8, 81, 82, 83 of production machines, building technology, energy generators/consumers, quantity detection and control, production logistics etc.

LIST OF REFERENCE SYMBOLS

1 Signaling column
2 Replaceable module
3 Cover
4 Base
5 Cable
6 Link
7 Light
8 Actuator
9 Computer
10 Screen
11 Antenna
12 Radio module
13 Router
20 Luminous element
21 Switch
22 Switch
23 Grounding
24 Reference potential
25 Branch-off point

26 Monitoring unit
27 Connections
28 Actuating element
29 Energy supply
30 Machine
31 Link
32 Controller
33 Machine center
50 Wind power plant
81 Electric motor
82 Hydraulic cylinder
83 Heating system

What is claimed is:

1. An optical signaling device having at least one luminous unit (2) for optically indicating one or more different operating states of a technical device (30) and at least one electrical or electronic connection unit (27) for connecting or making contact with the technical device (30) with at least one electrical or electronic linking unit (12) linking the electrical or electronic connection unit to the luminous unit (2) to illuminate a specific luminous unit in response to a specific operating state of the technical device wherein the improvement comprises at least one electrical or electronic switching element (21, 22) having an actuator switch (21, 22) for switching between a first actuator connected to the at least one electrical or electronic connection unit connected to the technical device (30) and a second actuator (8) to operate a separate external machine, unit or actuator that is different from or separate from the technical device (30).

2. The signaling device according to claim 1 further comprising a base (4) for holding the signaling device at an operating position and/or a module (2, 12) which can be replaced without tools.

3. The signaling device according to claim 1 or 2 wherein the electrical or electronic linking unit (12) has at least two electrical or electronic switching elements (21, 22) to establish and/or disconnect the electrical link between the luminous unit (2) and the at least one electrical or electronic connection unit (27).

4. The signaling device according to claim 1 further comprising at least one branch-off point (25) having an electrical supply line (24) for supplying electrical energy arranged between the two electrical or electronic switching elements (21, 22.

5. The signaling device according to claim 1 wherein the at least one electric or electronic switching element (21, 22) are two electrical or electronic switching elements (21, 22) and have a closed switching position at least in a switching phase whereby the electrical or electronic link between the at least one luminous unit (2) and the electronic connection unit (27) is electrically conductive.

6. The signaling device according to claim 1 further comprising at least one monitoring unit (26) to monitor or control and/or actuate the electrical or electronic switching element(s) (21, 22).

7. The signaling device according to claim 6 further comprising a base (4) and/or the module (2, 12) which can be replaced without tools including the at least one monitoring unit (26).

8. The signaling device according to claim 1 wherein the signaling device is a modular unit with a base (4) for holding the signaling device at an operating position on the technical device or to a second module (2, 12) for the signaling device wherein the second module can be released and fixed without tools to the signaling device or to a cover (3).

9. The signaling device according to claim 1 wherein the first actuator is connected to more than one technical device (30) and/or at least one other actuator.

10. The signaling device according to claim 1 wherein the signaling device is disposed on the technical device (30) in a building, and the second actuator (8) actuator activates at least one component of a heating system (83) and/or a ventilation system and/or an air-conditioning system and/or a different production machine (30) in the building.

* * * * *